United States Patent [19]

Sumitomo

[11] 4,180,129

[45] Dec. 25, 1979

[54] PLATE TYPE CONDENSER

[75] Inventor: Hiroyuki Sumitomo, Takatsuki, Japan

[73] Assignee: Hisaka Works, Ltd., Osaka, Japan

[21] Appl. No.: 831,497

[22] Filed: Sep. 8, 1977

[30] Foreign Application Priority Data

| | | | |
|---|---|---|---|
| Sep. 8, 1976 | [JP] | Japan | 51-108215 |
| Sep. 8, 1976 | [JP] | Japan | 51-108216 |
| Oct. 21, 1976 | [JP] | Japan | 51-127027 |
| Oct. 21, 1976 | [JP] | Japan | 51-127028 |

[51] Int. Cl.[2] ..... F28B 9/08

[52] U.S. Cl. ..... 165/110; 165/166; 165/170

[58] Field of Search ..... 165/110, 111, 166, 167, 165/170

[56] References Cited

U.S. PATENT DOCUMENTS

| | | | |
|---|---|---|---|
| 2,587,116 | 2/1952 | Clay | 165/170 |
| 2,596,642 | 5/1952 | Boestad | 165/166 |
| 3,430,693 | 3/1969 | Egenvall | 62/290 |
| 3,840,070 | 10/1974 | Becker et al. | 165/110 |

FOREIGN PATENT DOCUMENTS

| | | | |
|---|---|---|---|
| 918616 | 2/1947 | France | 165/166 |

*Primary Examiner*—Sheldon Jay Richter
*Attorney, Agent, or Firm*—Armstrong, Nikaido, Marmelstein & Kubovcik

[57] ABSTRACT

A plate type condenser with a plurality of heat transmitting plates assembled face-to-face to form therebetween passages for steam and the cooling liquid alternately. The plate has in a heat transmitting surface, on which condensate occurs successively, a plurality of longitudinal grooves which serve for subjecting the condensate to flow down only in the grooves under the action of surface tension, and a condensate collecting and discharging means consisting of inclined grooves and vertical grooves, for the purpose of preventing the downflow liquid layer on the heat transmitting surface from its growth. The longitudinal groove is curved at the lower portion thereof along the inclination of the inclined groove, and the inclined groove is in the multistripes configuration to improve the condensate collecting and discharging performance. Decrease in pressure loss of steam is also accomplished in addition to the advance of the condensate discharging performance by constructing the inclined groove in the form of weir with a weir plate which is provided on the steam passage side thereof with a plurality of overhangs opening in the direction of the stream of steam.

4 Claims, 11 Drawing Figures

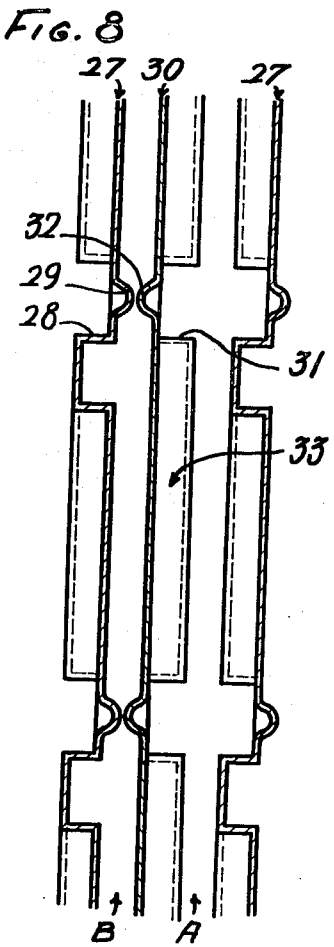
FIG. 8
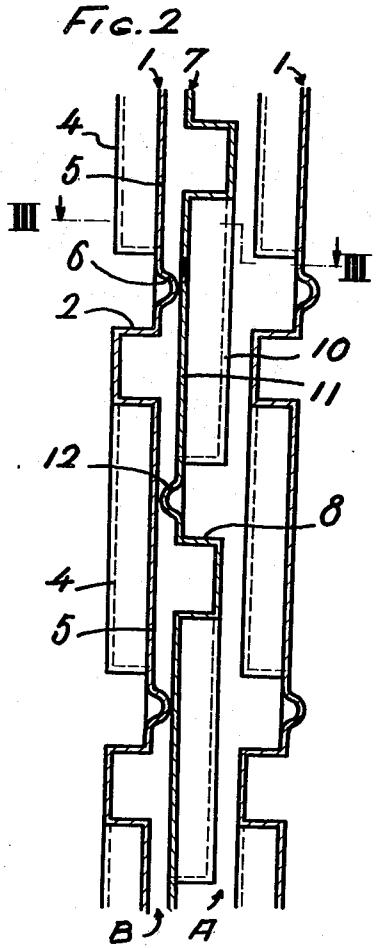
Prior Art
FIG. 2
Prior Art
FIG. 1
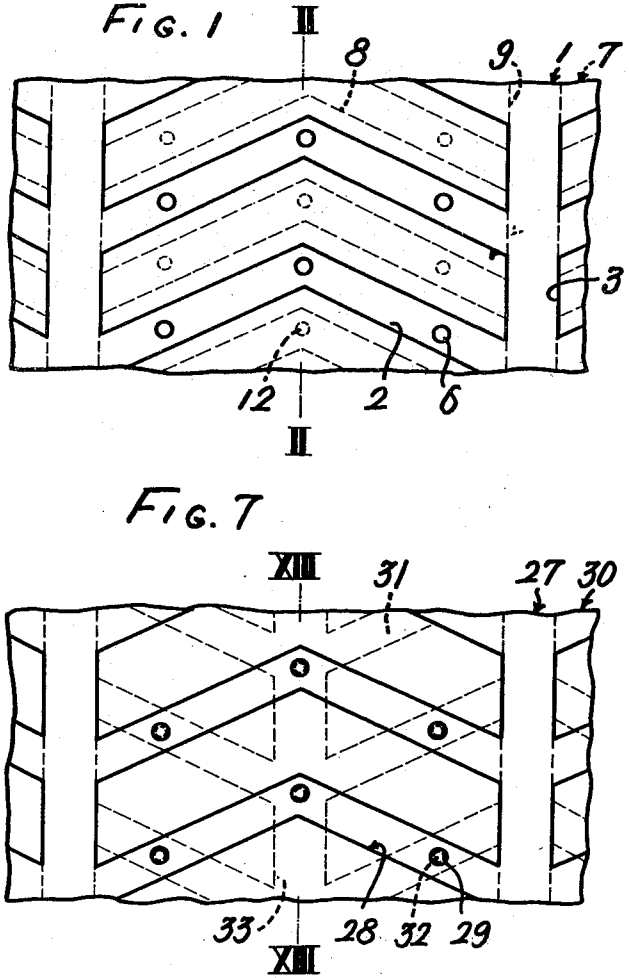
FIG. 7

PLATE TYPE CONDENSER

BACKGROUND OF THE INVENTION (a) The present invention relates to a plate type condenser comprising a plurality of heat transmitting plates assembled face to face to form therebetween alternate passages for steam and the cooling liquid so that the steam condenses as a result of heat transmission between the steam and the cooling liquid.

(b) In improving the heat transmitting ability of such kind of a condenser, what becomes a problem is "film coefficient", which is defined as the heat conductivity of the film divided by the thickness of the film and varies with the condition of the heat transmitting surface, i.e. it is decided by adhering conditions of condensate onto the heat transmitting surface.

As condensation continues to occur, this film becomes gradually thicker and eventually flows down along the vertical heat transmitting surface under its own weight until a thick layer of downflow liquid is formed in the lower region of the heat transmitting surface substantially throughout its width. This downflow liquid layer becomes gradually thicker towards in the downstream direction and the heat transmitting surface covered with steam hence the film coefficient in this region is decreased, badly lowering the heat transmitting ability. Therefore, in order to improve the heat transmitting ability on the entire heat transmitting surface on which steam condenses, it is necessary to take measures capable of preventing the filmy downflow liquid layer from its growth in thickness as well as wideness.

To this end, the applicant's U.S. Patent Application Serial No. 750,909, filed December 15, 1976, discloses a condenser having heat transmitting surface whose condensate discharging effect is high. (refer Ser. No. 750,909 filed on Dec. 15, 1976) In this condenser, as shown in FIGS. 1–3 each of which illustrates the prior art, heat transmitting plates 1 and 7, which are assembled face to face so that steam passages A and cooling liquid passage B formed alternately therebetween, are provided with a condensate collecting and discharging means consisting of inclined grooves 2, 8 and vertical grooves 3, 9 and further provided with a plurality of longitudinal grooves (not shown in FIG. 1) in the form of a series of ridge parts 4, 10 and valley parts 5, 11 in section (when seen from the steam passage A side) extending in the direction of the stream of steam between the inclined grooves and communicating with one of the inclined grooves at their lower ends.

Condensate successively occurring on the heat transmitting and condensing surface is, as indicated with the chain line in FIG. 3, attracted into the valley parts 5, 11 under the action of surface tension, and flows down the valley parts under the influence of gravity toward the inclined grooves 2, 8. As a result, the film coefficient on the heat transmitting surface will be kept high and the heat transmitting ability will be improved, since no downflow liquid is formed on the ridge parts 4, 10.

However, even in the above described arrangement, condensate is liable to flood out of the inclined grooves and to flow down onto the lower region of the heat transmitting surface, for condensate flows down with large inertia force as its velocity increases. In this lower region, thus the liquid layer grows again, lowering the heat transmitting ability. Moreover, even if thermodynamically suitable heat transmitting ability is accomplished through the above described measures, there still remains a problem from the view point of hydrodynamics. If the amount of the cooling liquid supply is deficient due to, for example, a certain disadvantage in the construction of the cooling liquid passage, thermal polution or the like is brought about by the pyrogenic liquid exhausted out of the system because of the fact that mean temperature difference between the steam side and the cooling liquid side extremely decreases, in other words, temperature in the exhausted cooling liquid reaches to the last degree.

Such problem may be dissolved readily by supplying a large flow of cooling liquid, however, the amount of the cooling liquid supply is limited in accordance with the clearance of the cooling liquid passage so that the pressure loss does not increase. This clearance between the heat transmitting plates, which are maintained in a fixed distance by means of a plurality of hemispherical projections formed in the transmitting plate through the press work, is in turn limited in accordance with the height of the projections, and is not able to be extended over a given extent, since the height of the projections is limited within a possible range of the drawing ratio in the press work.

The steam passage is under the same circumstance that the passage clearance is limited within a fixed distance. Therefore, the pressure loss as well as the velocity of steam increases and condensate collected in and flowing down the inclined grooves is liable to scatter and to adhere onto the lower region of the heat transmitting surface. In addition, the number of the projections to be arranged on the heat transmitting plate is necessarily limited to a lesser extent so that the sectional area of the steam passage is not decreased due to the existence of the projections, and this means the reduction of mechanical strength for maintaining the passage clearance in a fixed distance.

SUMMARY OF THE INVENTION

Accordingly, it is an object of the present invention to provide a plate type condenser capable of demonstrating high heat transmitting ability by ensuring the condensate discharging effect.

It is another object of the present invention to provide a plate type condenser having such construction that allows the passage clearance between the heat transmitting plates not to be limited so that the pressure loss of steam as well as the cooling liquid is lowered.

It is a feature of the present invention that the longitudinal grooves at their lower ends in the direction of the inclination of the inclined grooves, in order to make the best of the condensate collecting and discharging performance, thereby condensate with great force of inertia will stream in without passing over the inclined grooves and flows down toward the grooves successfully.

It is another feature of the present invention that each of the inclined grooves arranged for each given region in the heat transmitting surface is formed in the multistripes configuration, thereby condensate is prevented from flooding and flowing down onto the lower region of the heat transmitting surface, regardless of how much condensate streams in.

Condensate is thus discharged through the valley parts of the longitudinal grooves, the inclined grooves and the vertical grooves in turn, so that the liquid layer is not formed on the ridge parts of the longitudinal grooves, and the heat transmitting ability is advanced.

It is a further feature of the present invention that each of the inclined grooves is constructed in the form of a weir by applying a weir plate at the lower part on the opening side of the inclined groove, in order that the condensate flowing down the inclined groove may be prevented from being blown out by the pressure of the steam and from adhering onto the lower region of the heat transmitting surface.

It is a further feature of the present invention that the weir plate is provided with a plurality of projections or overhangs each of which is open in the direction of the stream of steam and is disposed at a position corresponding to the ridge part of the adjoining heat transmitting plate, thereby when the overhang and the ridge part abut against each other the passage clearance for steam is defined between the adjoining plates.

It is a still further feature of the present invention that hemispherical projections are arranged on the cooling liquid passage side of each heat transmitting plate in such a manner that the projections on one of the two adjoining plates usually abut against the ridge parts of the counter plate, but when the counter plate is reversed they abut against that of the counter plate, thereby such clearance as available for both of small and large quantities of the cooling liquid supply is provided only by reversing the assembly of the heat transmitting plates.

The above and further objects and features of the present invention will more fully appear from the following detailed description when the same is read in connection with the accompanying drawings wherein examples are illustrated by way of example.

BRIEF DESCRIPTION OF THE DRAWINGS

FIG. 1 is a partial elevation of heat transmitting plates of the prior art,

FIG. 2 is a sectional view along the line II—II of FIG. 1,

FIG. 7 is a partial elevation of heat transmitting plates with one of adjoining plates being reversed, FIG. 8 is a sectional view along the line VIII—VIII of FIG. 7.

DESCRIPTION OF THE PREFERRED EMBODIMENT

Figure 4:
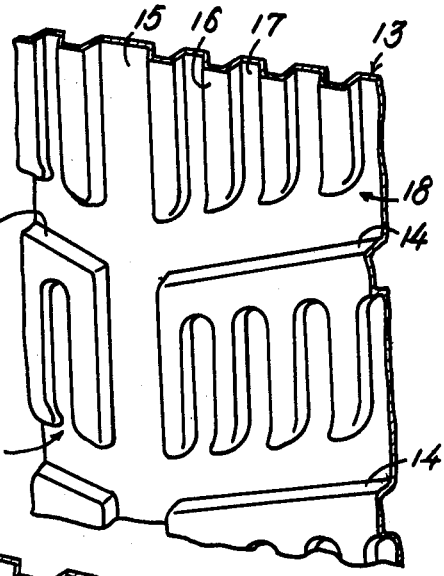
FIG. 4 is a perspective view of the steam passage side of a heat transmitting plate in an embodiment according to the present invention.

Referring first to FIG. 4 showing the steam passage side of a heat transmitting plate 13 according to the present invention, numeral 14 designates inclined grooves and numeral 15 designates vertical grooves. Numerals 16 and 17 designate, respectively, ridge parts and valley parts of longitudinal grooves, which act as a means for improving the film coefficient in such a way that condensate occurring on the ridge parts 16 is attracted into the valley parts 17 under the action of surface tension and flows down only in the valley parts 17 under the influence of gravity.

According to the present invention, the longitudinal grooves have a curved configuration, that is, valley parts 17 are curved at their lower ends 18 where the valley parts 17 communicate with the inclined groove 14. Curvatures thereat may be determined suitably in accordance with the velocity of downflow condensate after consideration of the capacity of a condenser and the steam velocity. In this construction of longitudinal grooves, condensate streams in the inclined groove 14 from the valley parts 17 along the curvature at the lower ends 18, resisting the vertical force of gravity, whereby the condensate discharging performance is ensured.

Figure 5:
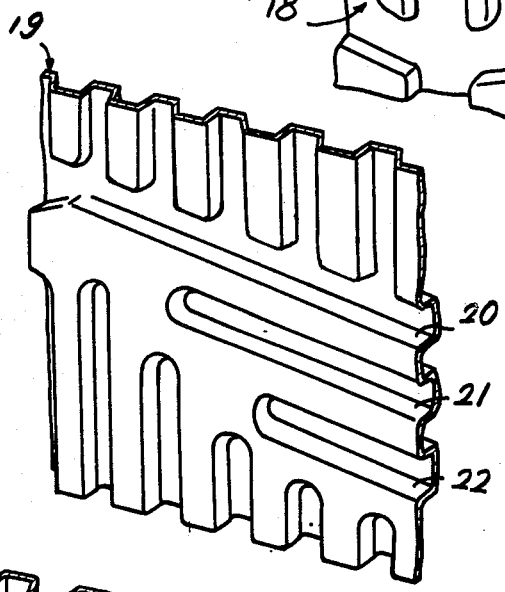
FIG. 5 is a perspective view of the inclined groove portion of a heat transmitting plate in accordance with the present invention.

Referring to FIG. 5 showing an inclined groove portion of a heat transmitting plate 19, every inclined groove is formed in the multi-stripes configuration by providing with the second stripe 21 and the third stripe 22 additionally in parallel to the original stripe 20 so that the condensate discharging performance thereof is ensured. The lower stripe 22 starts from the downstream point compared with the point where the upper stripe starts. These stripes 20, 21 and 22 communicate at their lower ends with a vertical groove (not shown in FIG. 5).

In spite of the fact that usually condensate flowing in each inclined groove tends to flood out owing to that the additional inflow from the valley parts of the upper region of the heat transmitting surface causes the flow in the inclined groove to increase, and as well in such case the flooding amount increases toward the downstream end of the inclined groove, the lower region is protected from being covered with the downflow liquid layer in such a way that, even if the condensate floods out of the original stripe 20, the flooded condensate is received or grasped by the second stripe 21 and secondly by the third stripe 22.

Figure 6:
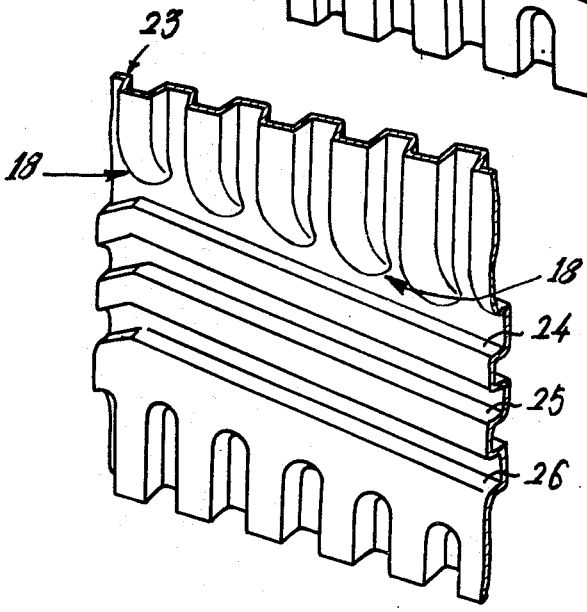
FIG. 6 is a perspective view of another embodiment of a heat transmitting plate shown in FIG. 5.

In a modified embodiment shown in FIG. 6, the second stripe 25 and the third stripe 26 are formed in parallel to the entire length of the original stripe 24 in the heat transmitting plate 23 for the purpose of the same effect with the above mentioned embodiment, but this arrangement meets with good result particularly when condensing capacity of a condenser is great in itself.

The sectional shape and the number of the stripes in an inclined groove are not restricted to that which are illustrated and described on the above embodiments, but the desirable results for receiving and discharging the flooded condensate which tends to flow down under the influence of gravity is attributed to form every inclined groove in the multi-stripes configuration instead of merely enlarging the sectional area thereof.

Embodiments of the present invention for ensuring the condensate collecting the discharging performance to improve heat transmitting ability is heretofore described, and hereafter embodiments adapted for maintaining the passage clearance will be described.

Conventionally, as shown in FIG. 1, the heat transmitting plates 1 and 7 are assembled face to face, with both the inclined grooves 2 and 8 presenting a-shaped appearance and the projections 6 or 12 of each plate 1 or 7 abuts against the valley parts 11 or 5 of the counter plate 7 or 1 to define the passage clearance between the adjoining two plates 1 and 7.

Referring now to FIG. 7 showing two adjoining heat transmitting plates 27 and 30, with the counter plate, e.g. 30 being reversed, projections 29 and 32 abut against each other, thereby providing a wider clearance by the height of a projection. This allows the supply of a greater amount of cooling liquid so as to lower the temperature in the exhaust cooling liquid, without the increase in pressure loss of the former cooling liquid. Further, since the decrease in temperature of the exhaust cooling liquid remarkedly increases with the value in the mean temperature difference, other advantages are also brought about. One of them will be understood in light of the following equation:

$$Q=A\cdot U\cdot \Delta T$$

wherein the relationship between heat transmitting quantity (Q), heat transmitting area (A), general coefficient of heat transmission (U) and mean temperature difference ($\Delta T$) is demonstrated. In this equation, if the value in mean temperature difference ($\Delta T$) increases, the value in heat transmitting area (A) required for obtaining a predetermined value in heat transmitting quatity (Q) under the constant value in general coefficient of heat transmission (U) decreases. Consequently, it becomes possible to reduce heat transmitting plates in area or in number for a condenser to lower the manufacturing cost.

Present invention provides such a condenser of high adaptability to both small and large amounts of the cooling liquid supply and particularly to external conditions of installation, e.g. quantitive conditions of the cooling liquid source, probability of thermal polution rising and so on, only by reversing the assembly of the heat transmitting plates between an usual combination and a reversed combination. In the former combination the two adjoining plates 27 and 30, both of which present the appearance of the inclined grooves in Λ-shape, are assembled face to face to form therebetween a narrow passage clearance which serves for small flows of the cooling liquid supply, while in the latter combination the two adjoining plates 27 and 30, one of which presenting the appearance of the inclined grooves in Λ-shape and the other presenting the appearance of the inclined grooves in v-shape, are assembled to form a wide passage clearance which serves for permitting a larger quantity of the coolant supply. In order that the inclined grooves may preserve their function as the condensate collecting and discharging means also when the counter plate of the adjoining plates is reversed, additional vertical grooves communicating with each of the inclined grooves at the point of v-shape should be provided in the heat transmitting plate to be reversed or in both of the adjoining plates. Two kinds of gaskets should also be prepared considering the passage clearance so thus the gasket height varies with the reversing operation.

Figures 3, 9, 10, 11:
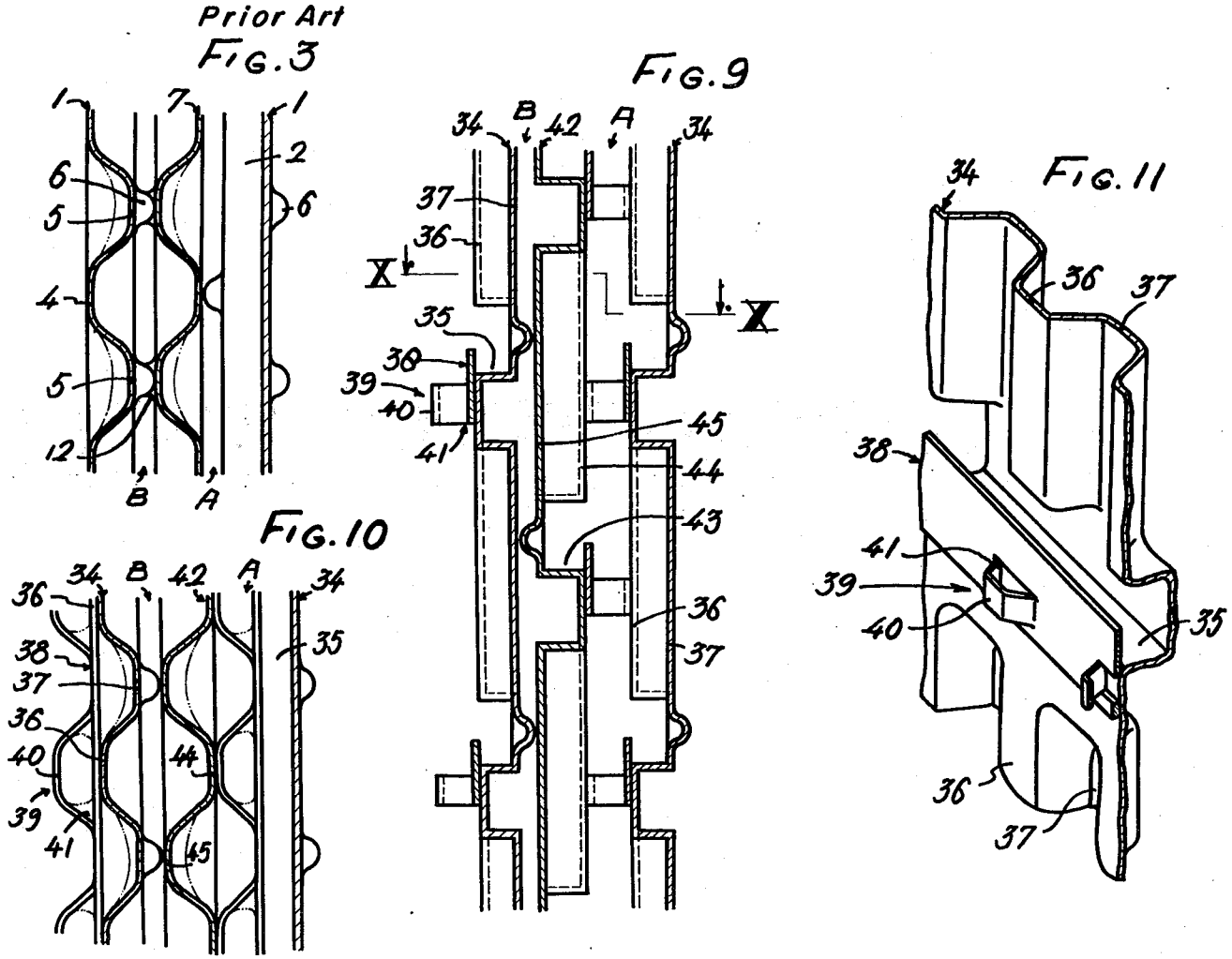
FIG. 10 Prior Art
FIG. 3 is a sectional view along the line III—III of FIG. 2.
FIG. 9 is a sectional view of heat transmitting plates showing another embodiment of the invention.
FIG. 10 is a sectional view along the line X—X of FIG. 9.
FIG. 11 is a perspective view of the heat transmitting plate shown in FIG. 9.

Referring to FIG. 9 showing in section a portion of the heat transmitting plates 34 and 42, each of the inclined grooves 35 and 43 is constructed in the form of a weir by applying a weir plate 38 at the lower part on the opening side thereof. This weir plate 38 is formed through the press work so as to provide a plurality of projections or overhangs 39 which project toward the steam passage A side and which are open in the direction of the steam stream. These overhang portions 39 are so spaced that they correspond to the ridge parts 44 or 36 of the counter plate 42 or 34 of the two adjoining plates 34 and 42 and they are of such height that defines a predetermined clearance of the steam passage A by the overhangs abutting against the ridge parts when the plates are assembled.

Since the height of the overhang 39 may be determined appropriately relative to the conventional projection of hemisphere-shape, the clearance of the steam passage A will be maintained wide enough for the decrease in the pressure loss of steam. As well, the overhangs preserve sufficient strength for maintaining the clearance between the plates, since the overhangs 39 open in the direction of the steam stream and they exert little influence on the steam passage sectional area even if the number thereof increases.

Condensate in each inclined groove in the form of a weir will stream toward the vertical groove without being blown out by the pressure of steam. Also it should be stressed that the overhangs according to the present invention performs the function of actual heat transmission. This is well understood as compared with that the hemispherical projections 12 do not carry out the function as seen in the light of the illustration in FIG. 3. That is, as shown in FIG. 10, condensate occurred on a substantially flat crest portion 40 of the overhang 39 is attracted into the condensate flowing down in a base portion 41 of the overhang under the influence of surface tension, thereby the crest portion 40 is not covered with the downflow liquid layer and acts as an effective heat transmitting element with a high film coefficient.

Although the invention has been described in its preferred form with a certain degree of particularity, it should be understood that various modifications or variation may be resorted to without departing from the spirit and the scope of the invention as hereinafter claimed.

What is claimed is:

1. In a plate type condenser comprising a plurality of heat transmitting plates assembled face to face to form therebetween passages for steam and cooling liquid alternately, each of said plates having a condensate collecting and discharging means consisting of inclined grooves and vertical grooves arranged for each given region in a heat transmitting surface on the steam passage side thereof, and a plurality of longitudinal grooves extending between the the inclined grooves in the direction of the condensate stream and communicating at the lower end thereof with the inclined groove, wherein the improvement which is characterized in that the longitudinal grooves are curved smoothly at their lower portions in the direction of the inclined groove.

2. In a plate type condenser comprising a plurality of heat transmitting plates assembled face to face to form therebetween passages for steam and cooling liquid alternately, each of said plates having a condensate collecting and discharging means consisting of inclined grooves and vertical grooves arranged for each given region in a heat transmitting surface on the steam passage side thereof, and a plurality of longitudinal grooves extending between the inclined grooves in the direction of the condensate stream and communicating at the lower end thereof with the inclined groove, wherein the improvement which is characterized in that each of said inclined grooves is formed in multi-stripes configuration, each of stripes in the inclined groove communicating with the vertical groove at the lower end thereof.

3. A plate type condenser as set forth in claim 2, characterized in that each stripe of the inclined groove is same in length with the others.

4. A plate type condenser as set forth in claim 2, characterized in that each stripe of the inclined groove differs from the others in length and that the lower stripe starts from the downstream point compared with the upper stripe.

* * * * *